US005803751A

United States Patent [19]

Liu

[11] Patent Number: 5,803,751

[45] Date of Patent: Sep. 8, 1998

[54] SOFT DOCKING INTERFACE

[75] Inventor: King-Heng Liu, Thornhill, Canada

[73] Assignee: Canadian Space Agency, Montreal, Canada

[21] Appl. No.: 652,224

[22] Filed: May 23, 1996

[51] Int. Cl.[6] ..... H01R 11/30

[52] U.S. Cl. ..... 439/39; 439/374

[58] Field of Search ..... 439/38–40, 374, 439/376, 378

[56] References Cited

U.S. PATENT DOCUMENTS

| | | | |
|---|---|---|---|
| 3,713,370 | 1/1973 | Prijn | 439/39 X |
| 3,786,391 | 1/1974 | Mathauser | 439/39 |
| 3,810,258 | 5/1974 | Mathauser | 439/39 |
| 4,451,113 | 5/1984 | Zuniga | 439/40 |
| 5,431,570 | 7/1995 | Gibbs et al. | 439/39 |

*Primary Examiner*—Khiem Nguyen
*Attorney, Agent, or Firm*—David J. French

[57] ABSTRACT

A coupling interface is provided with male/female coupling members that are shaped to self-align on interfitting magnetic means carried on the faces being mated tend to draw the coupling members together at the last stage of inter-engagement.

8 Claims, 3 Drawing Sheets

SOFT DOCKING INTERFACE

FIELD OF THE INVENTION

This invention relates to a soft-docking interface by which components intended to be joined together can be temporarily positioned in contact to each other before final coupling is effected. While described in respect of orbital applications such as the installation of Orbital Replaceable Units ("ORU's") on space hardware, the soft-docking interface is suited to robotic and other applications where it is desired to mate components together.

BACKGROUND OF THE INVENTION

A docking interface is intended to assist in the precise positioning and mating of objects by providing a final alignment once an approximate mating, within a tolerance range, has been effected. This invention introduces the concept of a "soft" docking interface which provides a moderate binding force between the articles, holding them together by a relatively light force once they are mated. Such a "soft" coupling can be separated by the application of a moderate amount of force, typically that which an astronaut can exert unaided.

A known soft docking interface relies upon self-toggling latches that engage and bind an object to be positioned by being tripped through the application of an engagement force. In space this is inconvenient, since the reaction on the machine or astronaut applying such force must be absorbed. A soft-docking interface that does not require the application of an engagement force is, therefore, desirable in space applications.

It is a requirement in space applications to also provide support for orbital pay loads, particularly ORU's, during the acceleration phase of lift-off from earth. A docking interface for an ORU can conveniently serve as the thrust-bearing surface during this activity.

It is with these and further objects in mind that the soft-docking interface of the invention has been conceived.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

In its broader aspects, the invention comprises a connection or coupling interface between two objects, such interface having at least two pairs of coupling members have coupling surfaces, the surfaces within each pair being complementary in shape to each other and formed to guide the coupling members into alignment as they close together. One male member of each pair of coupling members is provided with a ridge and the ridges of at least two opposed male members are aligned. An inherent advantage of this form of alignment is that if one half of the interface is thermally expanded, it will still engage with the other half. Optionally, associated with the interface are magnetic means positioned to effect final alignment and closure between the surfaces being mated.

The role of the magnetic means in the course of a soft docking is to not only draw the coupling members, and hence the two objects, together but also to bias the angular positions of the objects to rotate them into alignment for final coupling. The coupling members are shaped in respective male and female pair members that interfit and self-align as they close-up. In a preferred arrangement a magnetic coupling means is positioned proximately to each of such coupling pairs to provide increasing attractive force as the alignment and coupling action proceeds to completion.

In a preferred variant one male member of each pair of coupling members is provided with a protrusion having three planar surface sections that meet at a common point. Each of the three surfaces is oriented at an angle, preferably 45 degrees, from a common plane passing through the common point. More preferable, the said three surfaces correspond in their orientations to portions of the surfaces of three sides of a four-sided equilateral pyramid having the common point as its apex, This provides two opposed surfaces and a contained surface therebetween. Preferably, the two opposed faces bounding the contained surface share a common line of intersection, defining a ridge that terminates at the common point.

The other female member of each pair of members has an indented coupling surface that is complementary in shape to the surfaces of the male member.

Each pair of members may be provided with coupling means, such as screw holes, for their attachment to the surfaces of objects at their coupling interface. Alternately, they may be welded in place on the surfaces of objects.

The male members of the at least two basic pairs of coupling members may be positioned along the coupling interface at a variety of spaced locations but with their respective ridges aligned with each other. They may be preferentially positioned on the coupling interface of respective objects to be mated with their contained surfaces so aligned that their central "directors" (being centrally located vectors extending perpendicularly from each contained surface) aligned to lie within a single director's plane. Preferably, the director's plane is positioned perpendicularly to the object surface carrying the male members of the two basic pairs of coupling members, and is aligned with the aforesaid ridge.

The female members are positioned on the other object to be mated at complementary locations to ensure engagement of the pairs during mating. Preferably, these pairs are separated to a maximum degree to maximize stability of support during lift-off.

If only two pairs of coupling members according to the invention are employed, then at least one further pair of coupling interfaces should be deployed to maximize the stability of support for the objects Preferably, such further pair of coupling interfaces have interfacing surfaces that are the same as that of the basic pairs of coupling members, but they may also be simply flat or other forms of contacting surfaces.

More preferably, four pairs of coupling members may be deployed in a common plane, positioned as two orthogonally located sets of two pairs each with the ridges of opposed male members aligned with each other.

The magnetic means which provides a binding force between coupling members, may be provided by a magnet or series of magnets, preferably positioned at a location or locations adjacent to the coupling surfaces. The other component of the magnetic means may be a complementary magnetic attractor means, such as a magnetizable metal plate; or optionally this magnetic attractor means may itself be a magnet. The magnet or magnets in both cases are preferably positioned adjacent to each pair of coupling means to allow flux coupling to occur between the magnet and attractor means when members of such pairs are separated by a short distance.

An advantage of using such magnetic binding is that no engagement force need be applied to cause a binding force to develop between mated objects at the last moment of mating.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
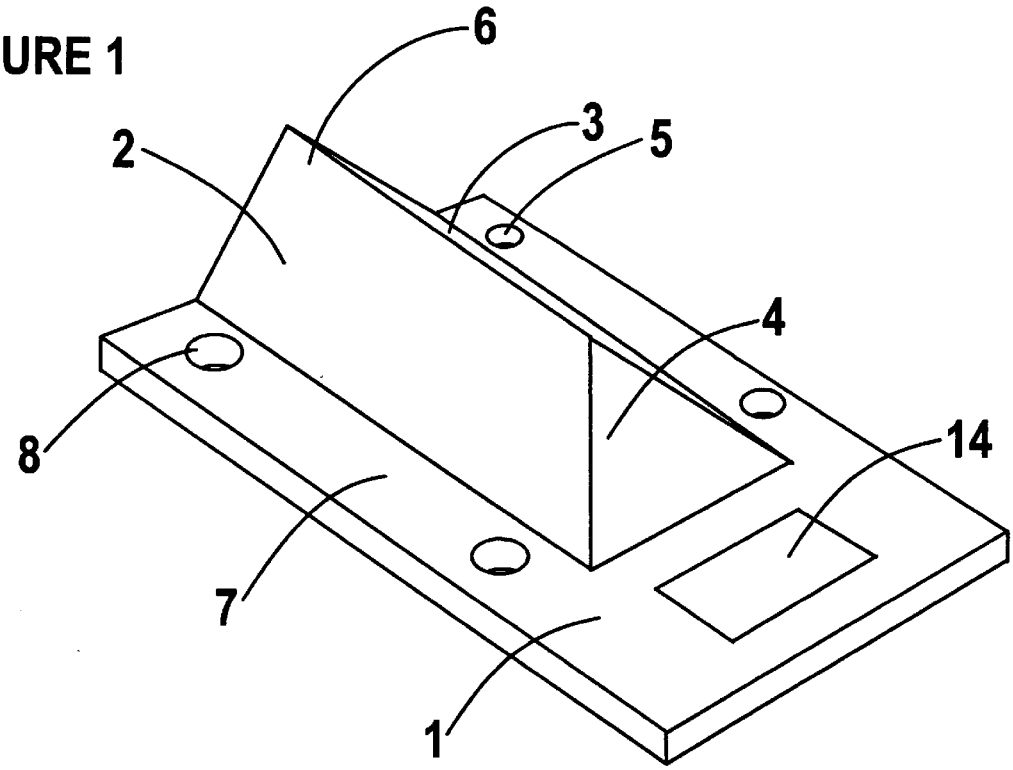
FIG. 1 shows a perspective view of a male member of a pair of coupling members.

In FIG. 1 a male coupling member has a base 1 and two angled coupling surfaces 2, 3. These angled surfaces 2, 3 and a contained surface 4 all meet at a common point 5.

Preferably, all three surfaces 2, 3, 4 are depressed at 45 degrees from a common plane (not shown) passing through the common point 5, parallel to the base 1.

The opposed surfaces 2, 3 intersect along a common line or ridge 6 that also passes through the common point 5 and lies within the common plane. The opposed surfaces 2, 3 rise from a base flange 7 that is pierced by screw holes 8 to serve as attachment or connection means.

Figure 2:
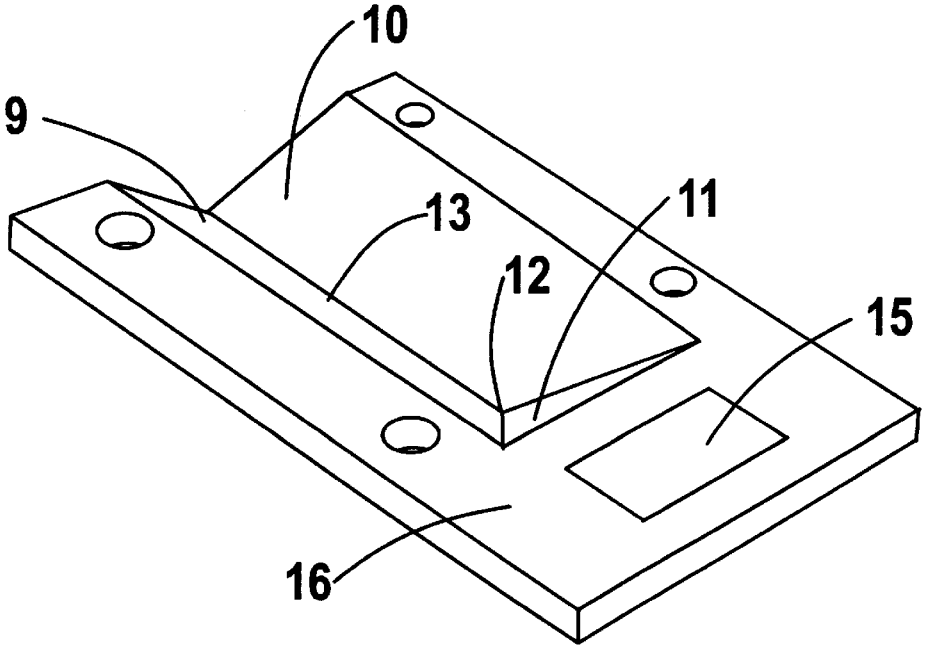
FIG. 2 shows a perspective view of a female member of a pair of coupling members.

The female member shown in FIG. 2 has a prismatically shaped groove bounded by two opposed angled surfaces 9, 10 and a contained surface 11 that all meet at a complementary common point 12. The intersection of the two opposed surfaces 9, 10 of the female pair is along a complementary common line 13 that passes through the complementary common point 12.

A magnet 14 is contained within a recess of base 1 and a magnetic attraction means 15, such as another magnet or iron plate is contained in the female base 16. These elements 1, 15 may be interchanged. The surrounding metal of the base 1 and female base 16 is preferably of a nonmagnetic material, such as aluminum.

Figure 3:
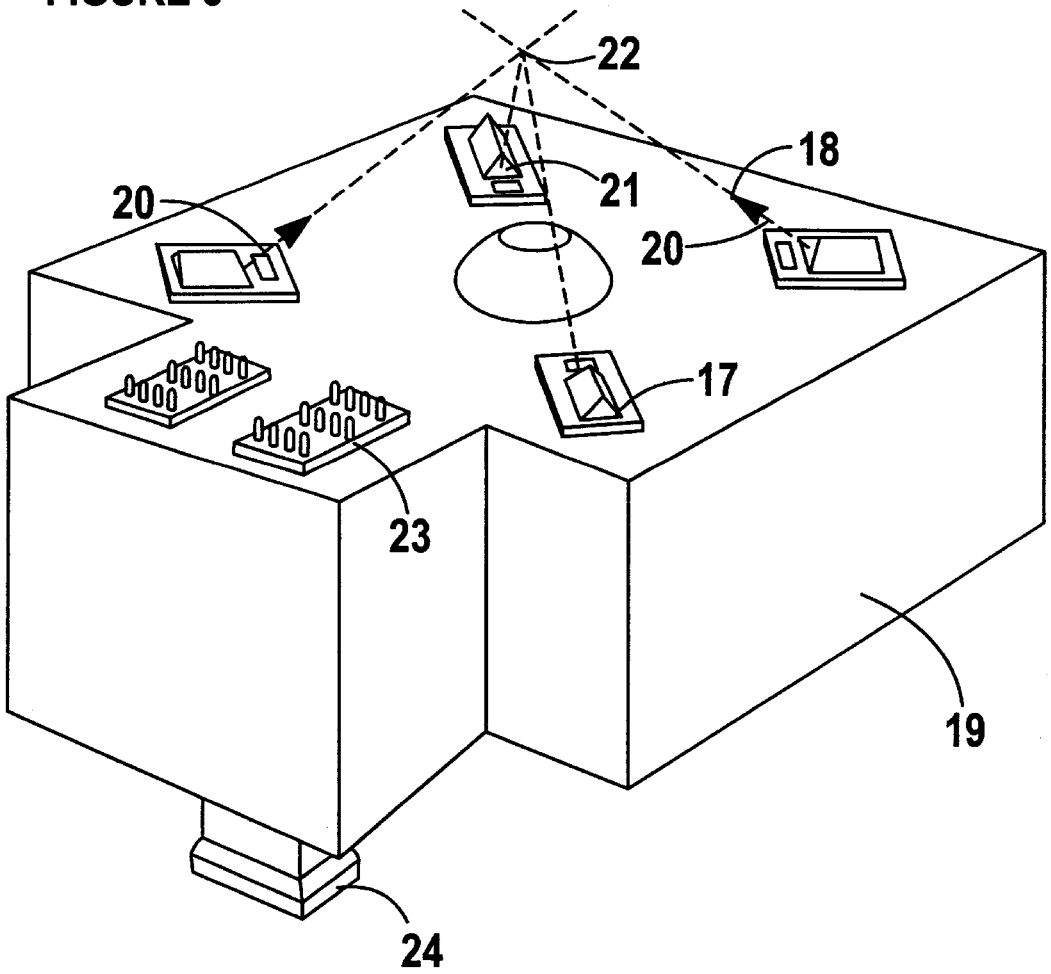
FIG. 3 shows a co-planar array of four male members of pairs of coupling members deployed in an orthogonal layout on a ORU object with electrical connectors.

In FIG. 3 four male coupling members 17 are positioned on the surface 18 of an orbital replacement unit 19 ("ORU") intended to be coupled to another object (not shown in FIG. 3). These four members 17 are preferably placed in opposed sets, set orthogonally to each other, with the contained surfaces 21 of each opposed set positioned to face each other towards or away from each. As well, the ridges 6 of opposed male members are aligned with each other. In FIG. 3 the surfaces 21 face towards each other. The central "directors" 20 extending from the centers of such contained surfaces 21 preferably lie in a single plane, such directors 20 when extended intersecting at an intersection point 22, preferable located above the surface 18.

Electrical connectors 23, 23A may be present at the interface, and a micro fixture 24 may be attached to the ORU 19 to facilitate its handling.

Figure 4:
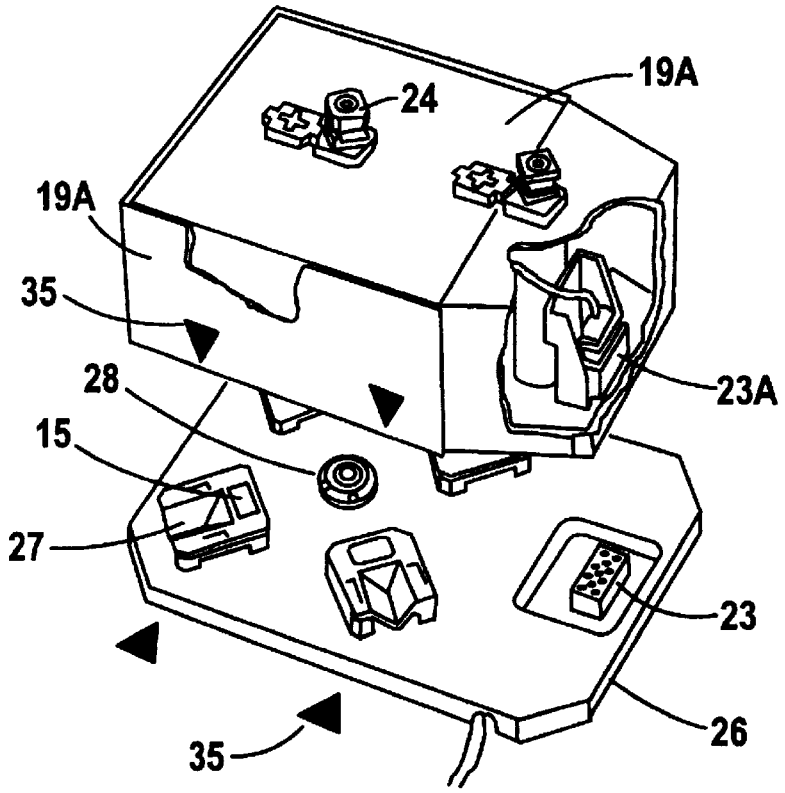
FIG. 4 shows an ORU being docked through the use of an array of four pairs of coupling members to provide a soft-docking interface.

In FIG. 4 an electrical box ORU 19A is suspended above a docking location on a plate 26. Both the ORU 19A and plate 26 carry coupling members 17, 27 which provide complementary soft docking interfaces. These are preferably orthogonally deployed at maximum spacing for optimum stability of engagement.

A corresponding docking interface to that on the plate 26 may be incorporated in the lift-off vehicle (not shown) to support the ORU 19A through its docking interface 27.

A floating nut 28 on the plate 26 is engaged by a bolt (not shown) passing through the grappling fixture 24 on the ORU 19A. The engagement of this bolt with the nut 28 completes the coupling of the ORU 19A to the base 26. Markers 35 aid the visual alignment prior to final coupling.

Before the coupling members 17, 27 are completely in final coupled position, the magnet 14 and magnet attraction means 15 tend to draw the coupling members 17, 27 together. Slight misalignments are converted into a correctional aligning torque when the surfaces 2, 3, and 4 of any one of the male coupling elements, come into contact with the surfaces 9, 10, 11 of a corresponding female coupling element and the magnetic means 14, 15 tend to draw these components together. The spaced separation of coupling members across the coupling interface with the magnetic means 14, 15 located adjacent to such members enhances the tendency of the magnetic means to produce a corrective torque.

Figure 5:
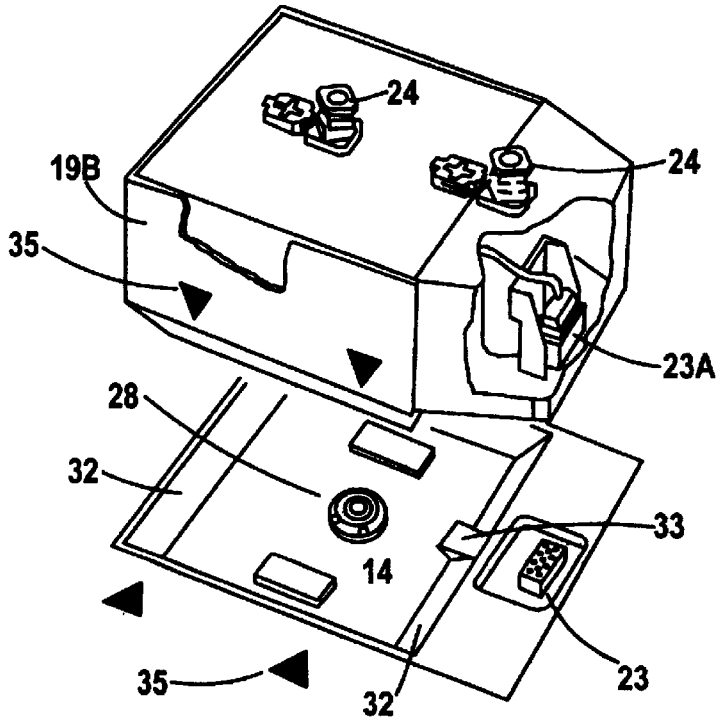
FIG. 5 shows a variant on FIG. 4 wherein a tapered recess is substituted for the four pairs of coupling members.

In FIG. 5 an alternate coupling interface is shown between an ORU 19B and a base 30. In this case a pair of magnets 14 are positioned in a recess 31 with sloping sides 32 formed in the base 30 and ORU 19B has a lower surface (not shown) of complementary shape. To prevent engagement in an incorrect orientation, an orientation key 33 formed on one side only of the recess 31 interfits into a complementary slot (not shown) on the ORU 19B.

The recess 31 and complementary surface on the ORU 19B represent an alternate form of coupling members.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed are as follows:

1. A connection interface for the coupling of two objects to be mated, such interface having at least two pairs of coupling members, the members of each pair being respectively positioned on the surfaces of the objects to be mated, said members of said pairs having coupling surfaces wherein the surfaces of each member within each pair are complementary male/female shapes to each other for guiding said members into alignment, wherein:

(a) one male member of each pair of coupling members is provided with a protrusion having three planar surface sections that meet at a common point;

(b) each of the three surfaces correspond in their orientations to portions of the surfaces of three sides of a four-sided equilateral pyramid having the common point as its apex;

(c) two opposed surfaces of the three surfaces bound the third contained surface and share a common line of intersection, defining along such line of intersection a ridge that terminates at the common point; and (d) the ridges of the male members of said at least two pairs of coupling members are aligned with each other to provide two pairs of aligned opposed coupling members.

2. An interface as in claim 1 being further provided with magnetic means to bias said coupling members to effect mutual engagement when in close proximity.

3. A coupling interface as in claim 2 wherein said magnetic means comprises within each pair of coupling members at a location adjacent to the coupling surfaces, a magnet associated with one of said coupling members, the other of said members having positioned adjacent thereto a complementary magnetic attractor means.

4. A coupling interface as in claim 3 wherein the magnetic attractor means is a magnet.

5. A connection interface for the coupling of two objects to be mated, such interface having at four pairs of coupling members, the members of each pair being respectively positioned on the surfaces of the objects to be mated, in an opposed, cross-shaped pattern defined by two sets of two pairs of coupling members, said members of said pairs having coupling surfaces wherein the surfaces of each member within each pair are complementary male/female shapes to each other for guiding said members into alignment, wherein:

(a) one male member of each pair of coupling members is provided with a protrusion having three planar surface sections that meet at a common point;

(b) each of the three surfaces correspond in their orientations to portions of the surfaces of three sides of a four-sided equilateral pyramid having the common point as its apex;

(c) two opposed surfaces of the three surfaces bound the third contained surface and share a common line of intersection, defining along such line of intersection a ridge that terminates at the common point; and (d) the ridges of the male members of each of the sets of said four pairs of coupling members are aligned with each other in conformity with said cross-shaped pattern.

6. An interface as in claim 5 being further provided with magnetic means to bias said coupling members to effect mutual engagement when in close proximity.

7. A coupling interface as in claim 6 wherein said magnetic means comprises within each pair of coupling members at a location adjacent to the coupling surfaces, a magnet associated with one of said coupling members, the other of said members having positioned adjacent thereto a complementary magnetic attractor means.

8. A coupling interface as in claim 7 wherein the magnetic attractor means is a magnet.

* * * * *